US007347123B1

(12) United States Patent
Toole et al.

(10) Patent No.: US 7,347,123 B1
(45) Date of Patent: Mar. 25, 2008

(54) HAMMER WITH EXTENDABLE HANDLE

(76) Inventors: Rodney Toole, 707 Laurel Dr., Vidalia, GA (US) 30474; Debra Toole, 707 Laurel Dr., Vidalia, GA (US) 30474

( * ) Notice: Subject to any disclaimer, the term of this patent is extended or adjusted under 35 U.S.C. 154(b) by 0 days.

(21) Appl. No.: 11/787,127

(22) Filed: Apr. 13, 2007

Related U.S. Application Data

(60) Provisional application No. 60/846,635, filed on Sep. 22, 2006.

(51) Int. Cl.
*B25D 1/00* (2006.01)

(52) U.S. Cl. ..... 81/20; 81/489

(58) Field of Classification Search ..... 81/177.1, 81/177.2, 20, 489
See application file for complete search history.

(56) References Cited

U.S. PATENT DOCUMENTS 5,099,724 A * 3/1992 Reddy, Jr. ..... 81/20

* cited by examiner

*Primary Examiner*—Jacob K. Ackun, Jr.
(74) *Attorney, Agent, or Firm*—James Ray & Assoc.

(57) ABSTRACT

A hammer includes a head and a shaft extending from the head. Extending around a distal end of the shaft is a tubular handle such that the handle is longitudinally moveable with respect to the shaft. The overall length of the handle, with respect to the head of the hammer, is therefore adjustable. A lock between the handle and the shaft locks the handle at one or more predetermined lengths.

2 Claims, 2 Drawing Sheets

HAMMER WITH EXTENDABLE HANDLE

CROSS REFERENCE TO RELATED APPLICATIONS

This application is closely related to and claims benefit from U.S. Provisional Application Ser. No. 60/846,635 filed Sep. 22, 2006.

FIELD OF INVENTION

The present invention relates to hammers and in particular to a hammer having a handle, the length of which can be extended or shortened.

BACKGROUND OF THE INVENTION

The hammer is a carpenter's most essential tool. Despite its importance in carpentry, a carpenter's hammer is highly standardized. A typical carpenter's hammer has a metal head having a flattened striking end, and opposite the striking end, a forked claw for removing bent or undesirable nails. Extending from a midpoint between the flattened end and the claw is an elongate handle having an overall length of approximately fifteen inches and made of a lighter material, such as wood, plastic, or aluminum. Surrounding the distal end of the handle is a gripping material made of rubber or the like, such that a carpenter, or other user, may easily grip the handle and swing its weight around an arc causing the flattened end of the head to impact on a target, such as the head of a nail.

In the course of a carpenter's work, it may occur that a hammer is needed to be used in a difficult to reach orientation, and under such circumstances, it might be desirable that the handle of the hammer be somewhat longer or somewhat shorter than the customary length. Presently, a carpenter faced with such a difficult construction work cannot employ an existing tool but must make due with an existing hammer, or remove the handle from the head of an existing hammer and construct a substitute handle having the desired length. It would be desirable, therefore, to provide a hammer having an adjustable length handle.

SUMMARY OF THE INVENTION

Briefly, the present invention is embodied in a hammer having a head that includes a contact surface and a shaft extending from the head in a direction generally parallel to the contact surface. A generally tubular handle surrounds the outer surface of the distal end of the shaft and the handle is longitudinally and telescopically extendable with respect to the shaft and the head.

In another embodiment of the invention, a lock is provided between the handle and the shaft wherein the distal end of the handle can be fixed to at least one predetermined length with respect to the head. In another embodiment, the distal end of the handle may be locked in a plurality of predetermined positions with respect to the shaft such that the overall length of the handle can be adjusted to any of a plurality of predetermined lengths, and locked into one of the predetermined lengths.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENT

Figure 1:
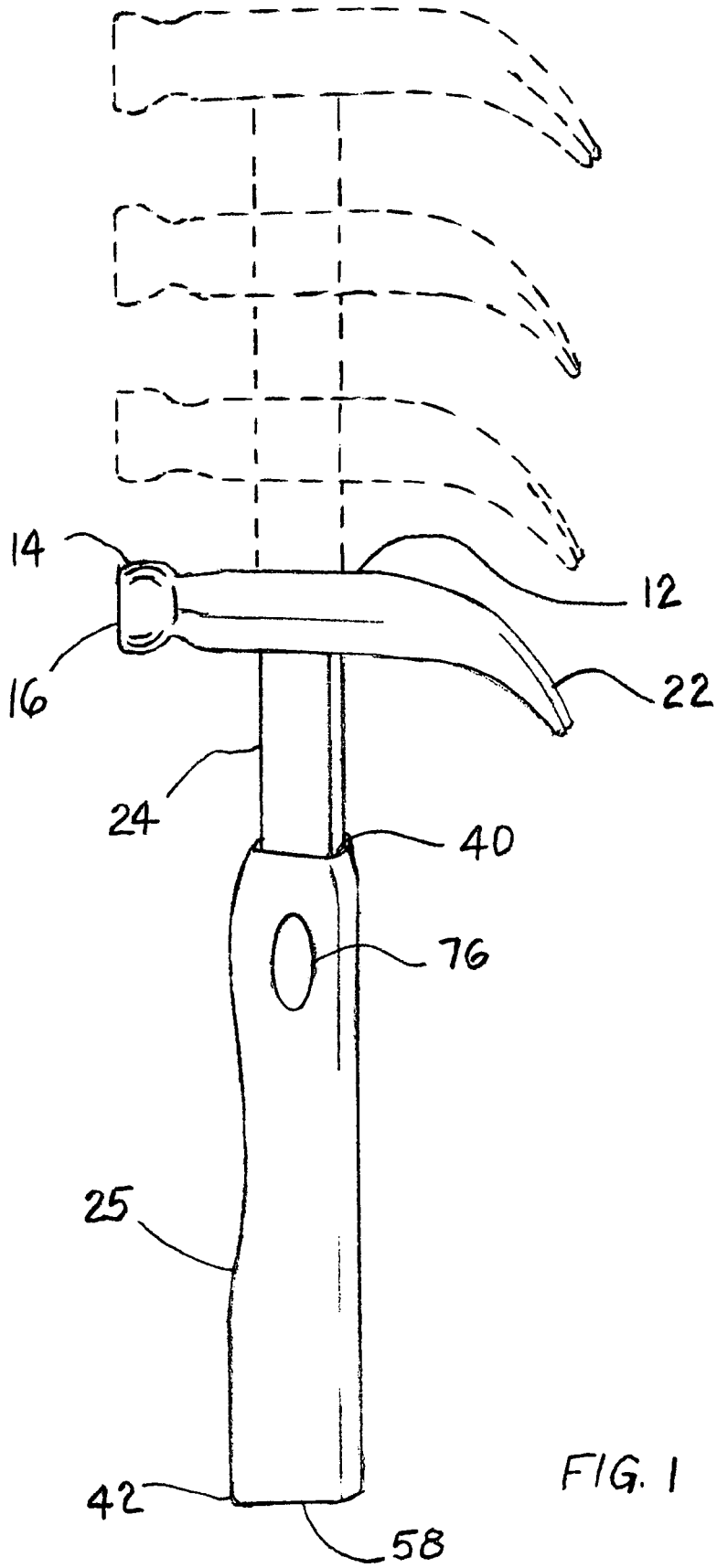
FIG. 1 is a side elevational view of a hammer in accordance with the invention, with the head shown in solid lines positioned at a minimum length, and shown in broken lines at a plurality of longer lengths.

Referring to FIG. 1, a hammer 10 in accordance with the present invention has a head 12. The head 12 may have any of a number of configurations, but for hammers used in carpentry, the head 12 includes a generally cylindrical striking end 14 having a planar end surface 16 intended to be used to strike an object such as the head of a nail, not shown. Behind the striking end 14 is an enlarged central portion 18 having a transverse hole 20 extending therethrough. Extending from the central portion 18 in a direction opposite from the striking end 14 is a forked claw 22, or some other tool, useable by a workman wielding the hammer 10. Where the hammer 10 is used by a carpenter, the claw 22 includes a wedge shaped groove, not visible, suitable for fitting around the head of a nail that is partially driven into a surface such that the claw 22 can be used to extract the nail.

Fitted into the transverse hole 20 and extending in a direction generally parallel to the end surface 16 and generally perpendicular to a line that joins the striking end 14 at one end and the claw 22 at the other end, is an elongate shaft 24. Preferably, the shaft 24 is made of aluminum, plastic, or some other material that has a weight lighter than the steel, or other metal of which the head 12 is made. Surrounding the distal end of the shaft 10 is a tubular handle 25.

For the purposes of this discussion the portions of the hammer 10 that are directed away from the distal end of the handle 25 and toward the head 12 will be referred to as forward or forwardly, and the portions directed way from the head 12 and toward the distal end of the handle 25 will be referred to as rearwardly or rearward. Also extending longitudinally through the length of the shaft 24 and the handle 25 is an axis 26, and the portions of the hammer 10 on the side of the axis 26 that included the strike end 14 will be described as being on the downward or downwardly side and those portions on the side of the axis 22 that include the claw 26 will be described as being along the upward side.

Figures 2, 3:
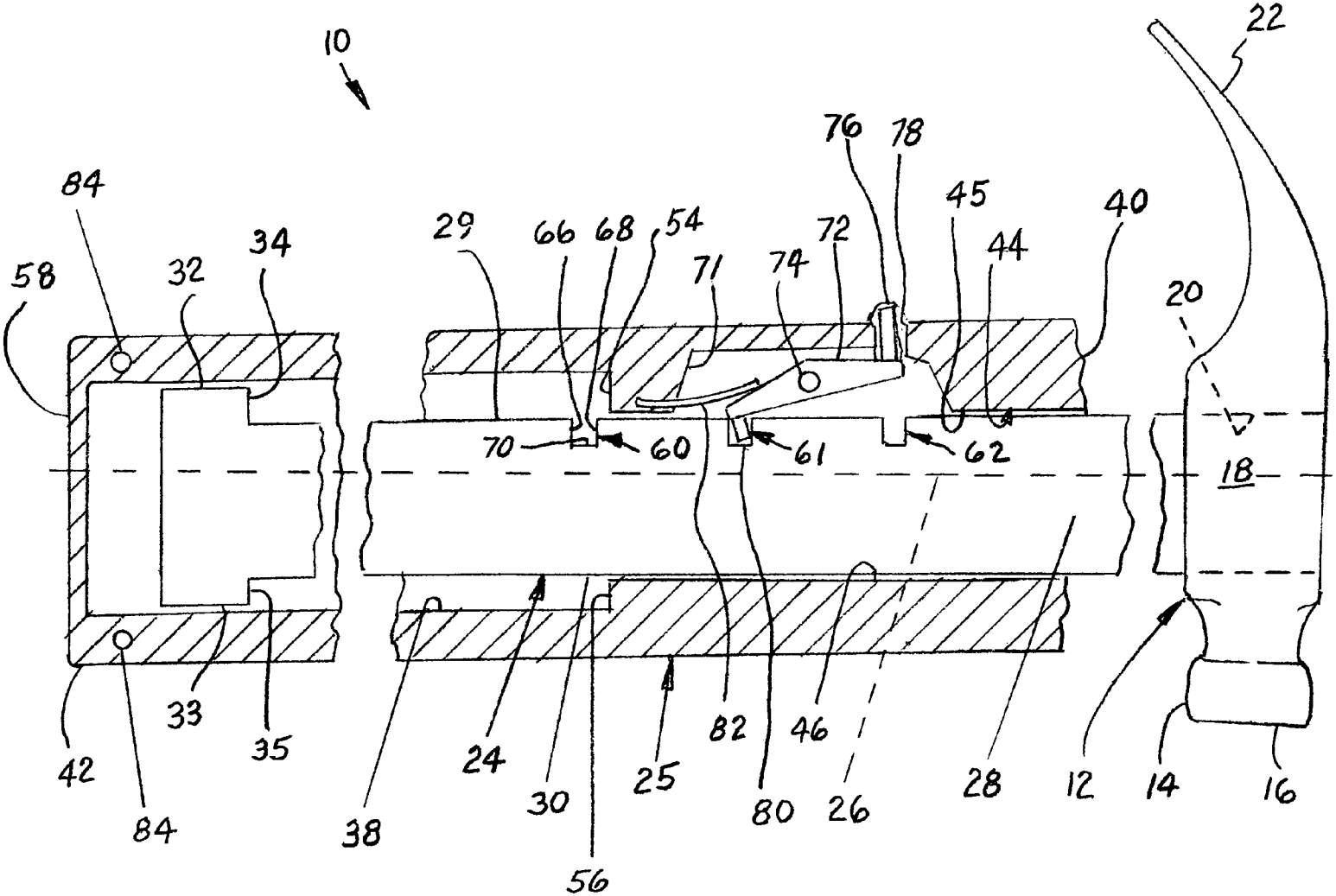
FIG. 2 is another side elevational view of the hammer shown in FIG. 1 with portions of the handle shown in cross-section to show the inner portions thereof and showing the distal end of the shaft fitted within the central opening within the handle.
FIG. 3 is a fragmentary enlarged cross-sectional view of the locking element within the handle as shown in FIG. 2.

Referring to FIG. 2, the shaft 24 has a generally rectangular cross-sectional shape, not visible, that includes two opposing generally parallel wide surfaces, one of which 28 is visible, and perpendicular to the wide sides 28 are another pair of parallel generally narrower upper and lower parallel surfaces 29, 30 respectively. Near the distal end of the shaft 24 and extending from the narrower surfaces 28, 30 are a pair of opposing flanges 32, 33, each of which forms a shoulder 34, 35 with its adjacent surface 29, 30 respectively.

Surrounding the distal end of the shaft 24 is the generally tubular handle 25 having a central opening 38, a forward end 40, and a rearward end 42. The forward portion 44 of the central opening 38 is open at the forward end 40 and has a generally rectangular cross-sectional shape and includes parallel upper and lower surfaces 45, 46 that are spaced apart a distance a little greater than the spacing between upper and lower surfaces 29, 30 of the shaft 24. Perpendicular to the surfaces 45, 46 are another pair of parallel surfaces, one of which is visible, that are spaced apart a distance that is a little greater than the spacing between the adjacent wide surfaces 28 of the shaft 24. The cross-sectional shape of the forward portion 44 is therefore a little larger than the cross-sectional shape of the shaft 24.

Rearward of the forward portion 44, the central opening 38 has parallel upper and lower surfaces 50, 52 that are spaced apart a distance that is a little greater than the spacing between the outer surfaces of the flanges 32, 33 such that the rearward portion of central opening 38 has a cross-sectional shape that is a little larger than the cross-sectional shape of the portion of the shaft 24 that includes the opposing flanges 32, 33. Upper shoulder 54 joins the upper surfaces 29, 50 of the forward and rearward portions 44, 38 and lower shoulder 56 joins the lower surfaces 30, 52 of the two portions 38, 44. Also, an end panel 58 extends across the rearward end 42 of the handle such that the inner opening 38 is not accessible from the rearward end 42. Accordingly, the handle 25 is longitudinally moveable with respect to the shaft 24. The handle 25 is moveable between a first position in which the rearward end of the shaft 24 abuts the end panel 58 of the handle 25 such that the overall length from the distal end 42 of the handle 25 to forward end of the head 12 is at a minimum, as shown in solid lines in FIG. 2, to a second position in which the shoulders 34, 35 of the shaft 24 abut the shoulders 54, 56 of the handle 25 such that the overall length is a maximum as shown in the longest broken lines of FIG. 2.

Referring to FIGS. 2 and 3, the upper surface 29 of the shaft 24 has a plurality of notches 60, 61, 62, therein and each of the notches has a generally rectangular shape. Notch 60 is typical of all the notches 60-62 and includes planar parallel surfaces 66, 68 spaced apart a short distance, perhaps one-eighth to one-fourth inch, and a bottom surface 70, generally parallel to surface 28 and spaced therefrom a distance of perhaps one-fourth inch.

Fitted in a cavity 71 is the upper surface 50 of the handle 25 is a lever arm 72 pivotable about a pin 74. The lever arm 72 has a projection 76 at one end thereof that extends through a hole 78 in the upper wall of the handle 25 with the distal end of the projection 76 extending outward of the outer surface of the handle 25. The opposite end of the level arm 72 has a second projection 80 that extends generally parallel to but in a direction opposite from the projection 76. The second projection 80 therefore extends into the forward portion 44 of the inner opening 38. The second projection 70 also has a width that is narrower than the spacing between the parallel surfaces 66, 68 of the notches 60-62 such that the distal end of the second projection 80 fits within any one of the notches 60-62 when one of the notches is aligned adjacent the projection 80. A spring 82, which may be in the form of a leaf as depicted urges the end of the lever arm with the second projection 80 thereon towards the central opening 38.

Preferably, the handle 25 is manufactured as a clamshell having two complementarily shaped portions that fit around the shaft 24 with the portions retained together by any suitable means, such as a plurality of screws, one of which 84 is visible in FIG. 2.

With the handle 25 assembled around the shaft 24 as shown, the shaft 24 is longitudinally moveable within the central opening 38 of the handle until the second projection 80 engages one of the notches 60-63. With the second projection 70 engaging one of the notches 60-63, the shaft 24 will be locked against longitudinal movement with respect to the handle 25. By depressing the first projection 76, the lever arm 72 will rotate around the pin 74 causing the second projection 80 to be withdrawn from engagement with one of the notches 60-63, after which the shaft 24 is again longitudinally moveable with respect to the handle 36. The handle 25 can therefore be locked such that the distance from the rearward end 42 of the handle 25 to the forward end of the head 12 can be adjusted to any one of a plurality of discrete lengths with each of the discrete lengths occurring when the projection 80 engages one of the notches 60-63. Four typical discrete lengths are depicted in FIG. 1 with the shortest discrete length corresponding to the shortest handle 25 position permitted with respect to the shaft 24, and the longest discrete length corresponding to the longest handle 25 position permitted with respect to the shaft 24. Preferably, the overall length of the handle, from the rearward end 42 to the forward end of the head 12, is adjustable from approximately fifteen and one-half inches to twenty-one and one-half inches. The user of the handle can therefore adjust the length of the handle thereof to fit the circumstances in which the hammer is to be employed without requiring the user to remove the head from the handle and construct a new handle of a suitable length.

While the present invention has been described with respect to a single embodiment, it will be appreciated that many modifications and variations can be made without departing from the spirit and scope of the invention. It is therefore the intent of the appended claims to cover all such modifications and variations that fall within the spirit and scope of the invention.

What is claimed:

1. A hammer comprising a head having a contact surface, a shaft having a predetermined shape extending from said head and having a distal end, a ledge portion formed at said distal end of said shaft and extending outwardly therefrom in a direction perpendicular to a longitudinal axis thereof, a plurality of notches having a predetermined shape formed to a predetermined depth in a predetermined surface of said shaft, a generally hollow handle open at one end thereof and closed at an axially opposed end thereof surrounding at least a portion of said shaft, said shaft longitudinally adjustable with respect to said handle, an abutment surface formed on an inner surface of said generally hollow handle for engagement with said ledge portion when said handle is fully extended, and a lockable length adjustment means pivotably disposed within said generally hollow handle and having a projection engageable within one of said notches formed in said shaft for locking said handle to said shaft at a desired length position.

2. A hammer according to claim 1, wherein said lockable length adjustment means further includes a projection extending through an aperture in said generally hollow handle for pivoting said adjustment means.

* * * * *